US005709302A

United States Patent [19]

Arai et al.

[11] Patent Number: 5,709,302

[45] Date of Patent: Jan. 20, 1998

[54] PACKAGE FOR FILM PRODUCT

[75] Inventors: Takuya Arai, Tokyo; Kazunori Mizuno, Minami-ashigara, both of Japan

[73] Assignee: Fuji Photo Film Co., Ltd., Kanagawa, Japan

[21] Appl. No.: 790,022

[22] Filed: Jan. 28, 1997

Related U.S. Application Data

[62] Division of Ser. No. 500,132, Jul. 10, 1995, Pat. No. 5,624,033.

[30] Foreign Application Priority Data

Jul. 11, 1994 [JP] Japan ..... 6-158723
Jun. 16, 1995 [JP] Japan ..... 7-150373

[51] Int. Cl.[6] ..... B65D 85/48

[52] U.S. Cl. ..... 206/455; 206/395; 206/469; 229/241

[58] Field of Search ..... 206/389, 316.1, 206/395, 410, 461, 467, 469, 455; 229/238, 240, 241; 220/403, 408

[56] References Cited

U.S. PATENT DOCUMENTS

| | | | |
|---|---|---|---|
| 3,438,563 | 4/1969 | Collura et al. | 229/238 |
| 3,620,439 | 11/1971 | Morse | 220/403 |
| 3,990,578 | 11/1976 | Roeser | 206/461 |
| 4,101,026 | 7/1978 | Bonk | 206/410 |
| 4,574,951 | 3/1986 | Weaver | 206/461 |
| 4,648,509 | 3/1987 | Alves | 220/403 |
| 4,694,960 | 9/1987 | Phipps et al. | 206/469 |
| 5,263,586 | 11/1993 | Keable | 206/407 |
| 5,381,202 | 1/1995 | Mizuno et al. | 206/389 |
| 5,624,033 | 4/1997 | Arai et al. | 206/469 |

FOREIGN PATENT DOCUMENTS

| | | |
|---|---|---|
| 62-208349 | 9/1987 | Japan . |
| 475341 | 7/1992 | Japan . |
| 66349 | 2/1994 | Japan . |

*Primary Examiner*—David T. Fidei
*Attorney, Agent, or Firm*—Sughrue, Mion, Zinn, Macpeak & Seas, PLLC

[57] ABSTRACT

A package for a film cartridge has a carton enclosing an inner holder which contains a sealed film product. The carton has a tab which is secured to a tab on the inner holder, so that both the inner holder and the carton are torn away at the same time along a tear line formed on the carton, when pulling the carton tab. In another embodiment, the inner holder has an upper and lower portion, and is enclosed within a central rectangular opening of a mount by two pieces of paperboard. There is a notch where the mount and the lower portion of the inner holder overlap, and a tear line is formed in connection with the notch on the mount, so that both the inner holder and the carton are torn away at the same time along the tear line.

29 Claims, 15 Drawing Sheets

PACKAGE FOR FILM PRODUCT

This is a divisional of application Ser. No. 08/500,132, filed Jul. 10, 1995, now U.S. Pat. No. 5,624,033.

BACKGROUND OF THE INVENTION

1. Field of the invention

The present invention relates to a package for a film product and more particularly to a package for a film product, such as a carton which houses a film cartridge storing a roll of photographic film which has not been exposed, and a simplified camera like a film unit with a lens and the like, which are sealed in a moisture-proof wrapper.

2. Description of the Related Art

Japanese Utility Model Laid-open No. 4-75341 discloses a wrapper which houses a film cartridge. In this wrapper, a film cartridge is packed in the wrapper, and an opening part of the wrapper is sealed with a heater and a hanging aperture is formed at the sealed part. As a result, the wrapper can be placed on a display rack at a store in such a state that a film cartridge is packed in the wrapper.

The above-mentioned wrapper does not have enough strength for packing a film cartridge. Moreover, in the case that a brand name etc. are printed on the sealed part for display and sale, there is a problem in that the brand name is difficult to be recognized because the sealed part is unevenly transformed due to the shape of the heating part of the heater. As a result, the by itself is not suitable for sale at the retail level.

To eliminate the above-mentioned problem, the film cartridge is generally sealed in a cylindrical plastic case with a cap, and is placed on a display rack at a store in such a state that the plastic case is housed in a carton on which a brand name etc. are printed.

The plastic case, however, is usually thrown out after the film cartridge is taken out. As a result, there is a problem in that the plastic case causes a disposal problem and wastes natural resources.

Therefore, there is now a package for a film product, in which the film cartridge is sealed in a moisture-proof package instead of the above-mentioned plastic case and the package is housed in a carton.

However, the conventional package for a film product has a problem in that it requires a lot of trouble to take out a film product. That is because a carton should be opened so that the wrapper can be taken out, and then the wrapper should be torn out so that the film product can be taken out.

Japanese Patent Application Laid-open No. 62-208349 discloses a package formed in such a manner that the internal surface of an outer case is laminated with a heat sealed layer on which a plastic tape is adhered so as to compose a double wall. Then, a plastic tape is peeled off so that the carton and the laminated heat sealed layer can be torn out at the same time. This package can be easily opened, however, it is not suggested to be applied as a package for a film product.

Moreover, in the package disclosed in Japanese Patent Application Laid-open No. 62-208349, the heat sealed layer is laminated on the internal surface of the outer case, so there is a disadvantage in that the package is difficult to fold and the outer case is not appropriate for recycling since an aluminum foil is laminated thereon.

SUMMARY OF THE INVENTION

The present invention has been developed under the above-described circumstances, and has its aim the provision of a package for a film product, which makes it easier to take out the film product and which is easy to fold and appropriate for recycling.

To achieve the above-mentioned object, in a package for a film product of the present invention, a wrapper has a tab, in which a film product is contained in a sealed condition, and a carton houses the wrapper in such a manner that the tab projects toward the outside thereof. At the time of taking out a film product, the tab of the wrapper, which projects from the carton, is pulled in a tear-out direction. As a result, the carton and the wrapper are torn out at the same time.

According to another package for a film product of the present invention, a carton for housing the wrapper has a carton tab, and a Wrapper containing a film product in a sealed condition has a second tab which is glued to the carton tab when it is housed in the carton. At the time of taking out a film product, the tab of the carton is pulled in a tear-out direction. As a result, the carton and the wrapper are torn out at the same time.

A package for a film product further comprises, a wrapper having at least one flatly formed part, in which a film product is contained in a sealed condition and a mount on which the flatly formed part of said wrapper is supported. Then, a cut formed in a portion in which the flatly formed part and the mount overlap each other. At the time of taking out a film product, the wrapper and the carton are torn out at the same time from said cut.

Furthermore, a package for a film product comprises a wrapper having at least one flatly formed part and a tab, in which a film product is contained in a sealed condition, and a mount on which the flatly formed part of the wrapper is supported. At the time of taking out a film product, the tab of the wrapper, which projects from the carton, is pulled in a tear-out direction. As a result, the wrapper is torn out at the same time.

As mentioned above, in the present invention, a single tear-out operation enables a user to tear out both of the carton and the wrapper. Therefore, the user can easily take out the film product.

Moreover, a package for a film product of the present invention, the carton and the wrapper are separately constructed, therefore, it is easy to recycle each component of the package.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures and wherein.

DESCRIPTION OF THE PREFERRED EMBODIMENTS

Detailed description will hereunder be given of the preferred embodiment of a package for a film product according to the present invention with reference to the accompanying drawings.

Figure 1:
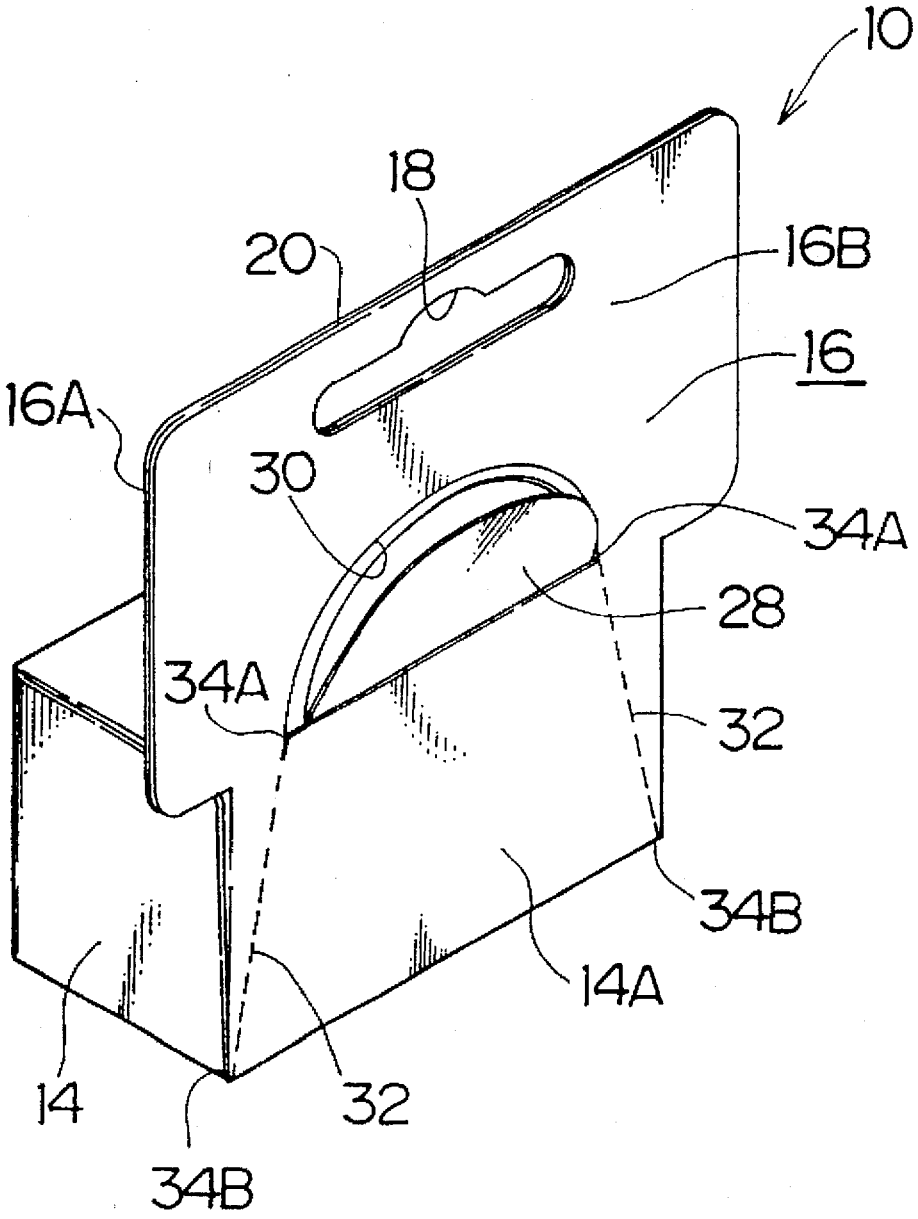
FIG. 1 is a perspective view illustrating an external appearance of a package for a film product according to the first embodiment of the present invention.

FIG. 1 is a perspective view illustrating the first embodiment in which a package for a film product according to the present invention is employed as a package for containing a film cartridge.

As shown in the drawing, the package for the film product comprises a paperboard carton 10 or an outer case and a wrapper 2 (refer to FIG. 12) which is housed in the carton 10.

The carton 10 comprises a film cartridge housing part 14 which has a box-shape, and a hanging part 16 which is attached to a rear wall 14A of the housing part 14. As a result, the carton 10 can be suspended via a hanging hold 18 which is formed on the upper portion of the hanging part 16 at a store for display and sale.

The hanging part (holding part) 16 is divided into two pieces of paperboard 16A and 16B by folding along a fold line formed on the hanging part 16 as shown in FIG. 1. A sealed part 22 of the wrapper 12 is held between the two pieces of the paperboard 16A and 16B.

On the other hand, the wrapper 12 comprises a main body 26 which is made of a moisture-proof material. The main body 26 is bag-shaped and its opening is sealed after containing a film cartridge and forms a sealed part 22. The main body 26 containing a film cartridge is housed in the film cartridge housing part 14 of the carton 10, and the sealed part 22 is held at the hanging part 16 as mentioned above.

Figure 2:
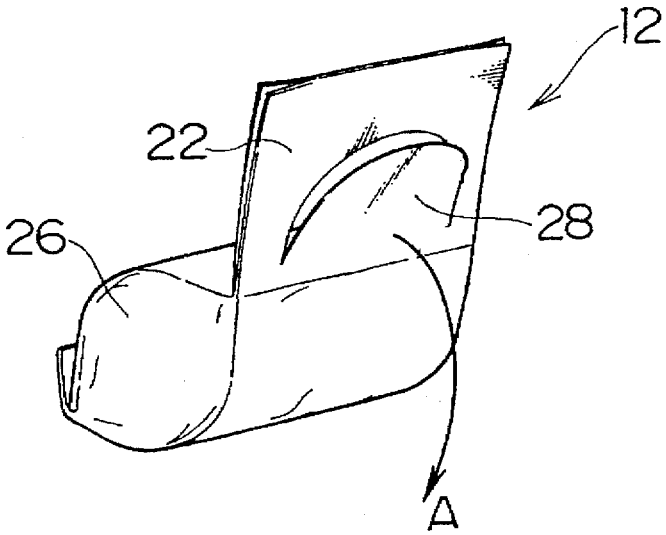
FIG. 2 is a perspective view illustrating an external appearance of a wrapper which seals a film cartridge.
Figure 3:
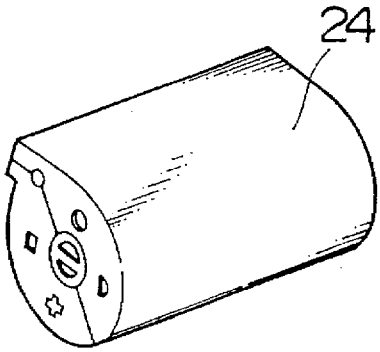
FIG. 3 is a perspective view illustrating an external appearance of a film cartridge.

A tongue-shaped tab 28 is formed in the direction in which the wrapper 12 extends (hereafter referred to as the extending direction, and shown with an arrow A in FIG. 2). Accordingly, when the tab 28 is pulled in the elongating direction, the main body 26 is torn out. As shown in FIG. 1, the tab 28 projects toward outside from an aperture 30 which is formed in the hanging part 16.

Tear lines 32 and 32 are formed on a rear wall 14A of the carton 10. These lines are formed between both of lower ends 34A and 34A of the window 30 and both of lower ends 34B and 34B of the rear wall 14A.

Figure 4:
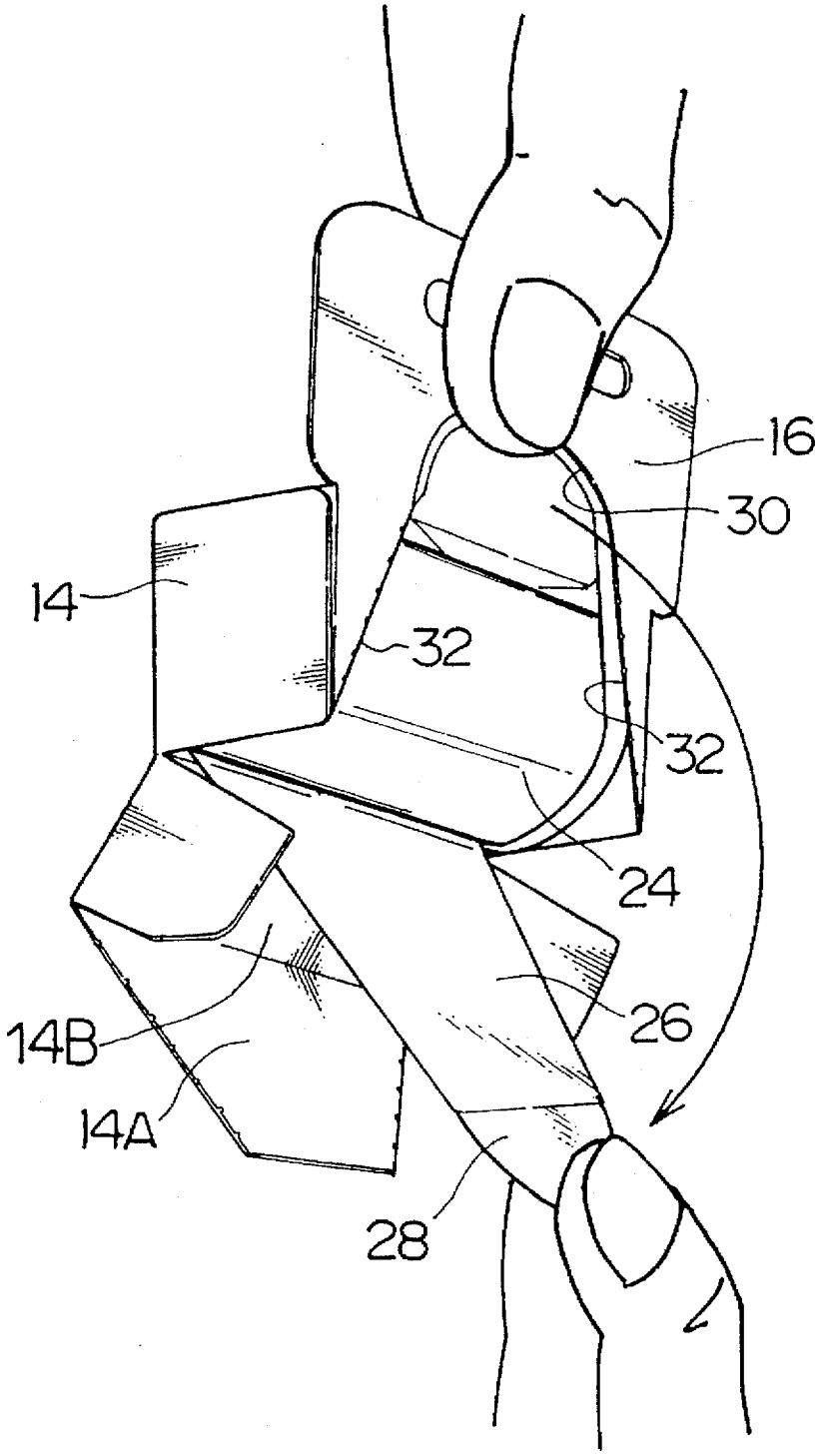
FIG. 4 is an explanatory view illustrating a state that a film cartridge is being taken out from a package for a film product according to the first embodiment of the present invention.

At the time of taking out the film cartridge from the package for the film product, which is constructed in the above-mentioned manner, for example, a user pinches the suspension part 16 with his left hand, and then pinches the tab 28 of the wrapper 12 projecting from the carton 10. Next, he pulls the tab 28 in a direction to tear out (hereinafter referred to as the tear-out direction) so that the rear wall 14A of the film cartridge housing part 14 can be torn out along the tear lines 32 and 32 as shown in FIG. 4, and then a bottom part 14B is also opened. At this time, the main body 26 of the wrapper 12 is torn out as well as the rear wall 14A. Here, the wrapper is constructed in such a manner that it can be easily torn out along the direction in which the carton is torn out. As a result, the film cartridge 24 is exposed from the carton 10, so that the film cartridge can be taken out.

Accordingly, in this package for the film product, the carton 10 and the wrapper 12 are torn out at the same time, so that the film cartridge 24 can be easily taken out.

Incidentally, in this embodiment, the wrapper 26 is held between the paperboards 16A and 16B, but the present invention is not limited to this. That is, the wrapper 26 can be glued to the holding part (hanging part). Furthermore, in this embodiment, the package is described as one for a film cartridge, but the present invention is not limited to this. It is also possible to apply it to a film unit with a lens as a simplified camera.

Figure 5:
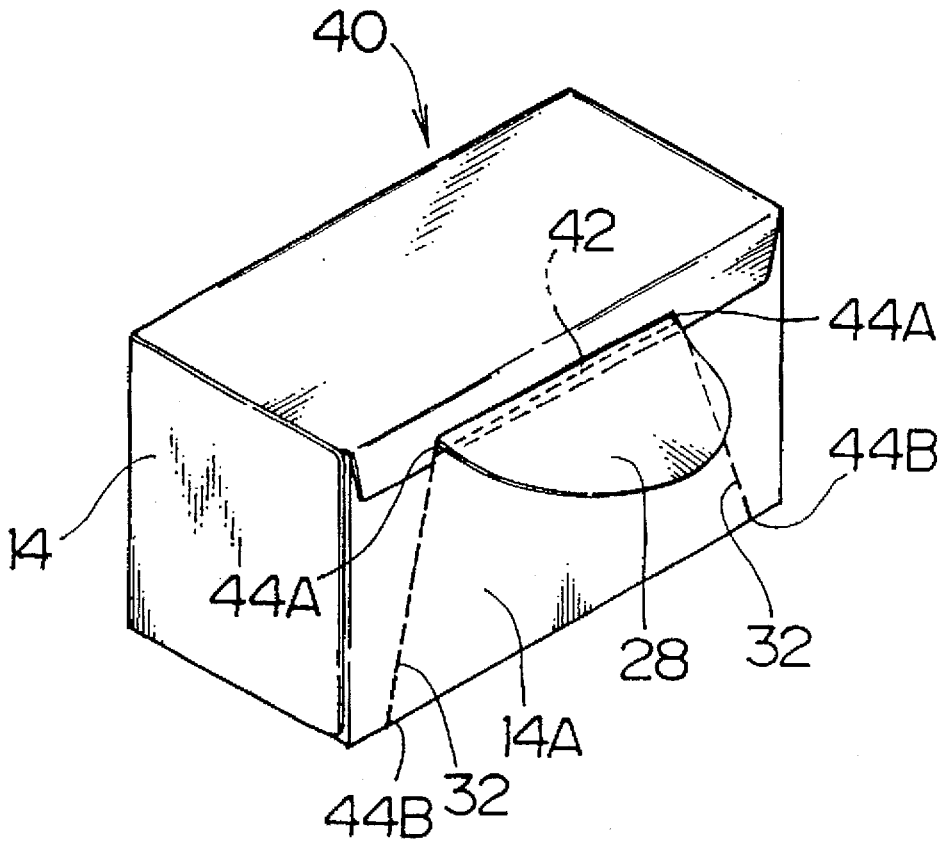
FIG. 5 is a perspective view illustrating an external appearance of a film package according to the second embodiment of the present invention.

FIG. 5 is a perspective view illustrating the second embodiment of the package for the film product according to the present invention. The same reference numerals are used to denote the same or similar parts as those of the first embodiment.

Figure 6:
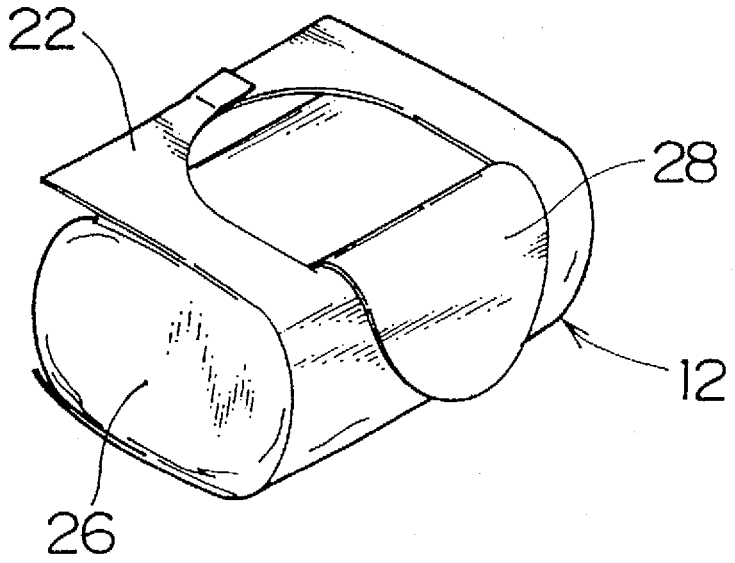
FIG. 6 is a perspective view illustrating an external appearance of a wrapper which seals a film cartridge.

The carton 40 in the package for the film product in this drawing comprises a box-shaped film cartridge housing part 14 only. The wrapper 12 is housed in the film cartridge housing part 14 in such a manner that a seal part 22 is wound around a main body 26 (see FIG. 6).

A slit 42 is formed on a side wall 14A of the film cartridge housing part 14 as shown with a dot-line in FIG. 5. A tab 28 of the wrapper 12 projects from the slit 42. Tear lines 32 and 32 are formed on the side wall 14A of the film cartridge housing part 14, and these tear lines 32 and 32 are formed from both ends 44A and 44A of the slit 42 toward both of lower ends 44B and 44B of the side wall 14A.

Figure 7:
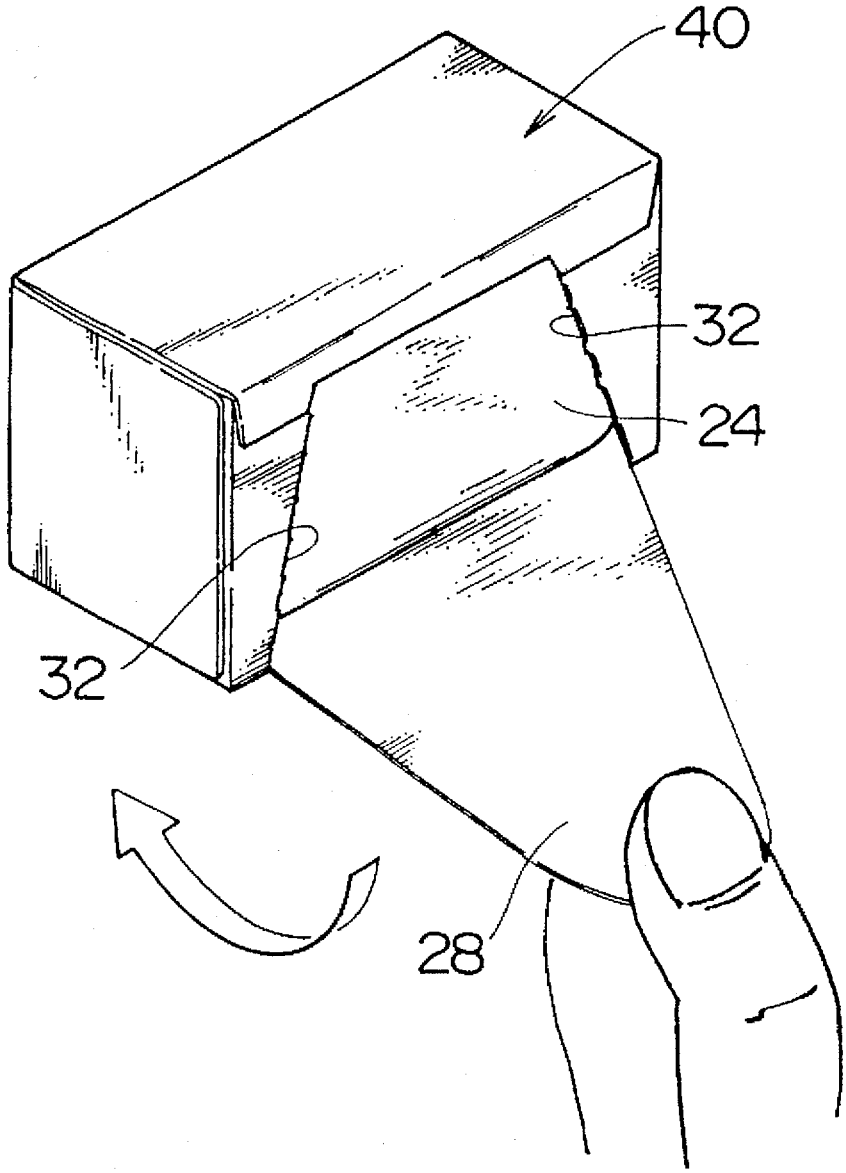
FIG. 7 is an explanatory view illustrating a state that a film cartridge is being taken out from a package for a film product according to the second embodiment of the present invention.

According to the package for the film product constructed in the above-mentioned manner, when the tab 28, which projects from the film cartridge housing part 14, is pulled in the tear-out direction, the film cartridge housing part 14 is torn out along the tear lines 32 and 32 as shown in FIG. 7. At this time, the wrapper 12 is also torn out, so that the film cartridge 24 can be easily taken out.

Incidentally, the wrapper 26 can be also glued to the holding part included in the carton 10.

Figure 8:
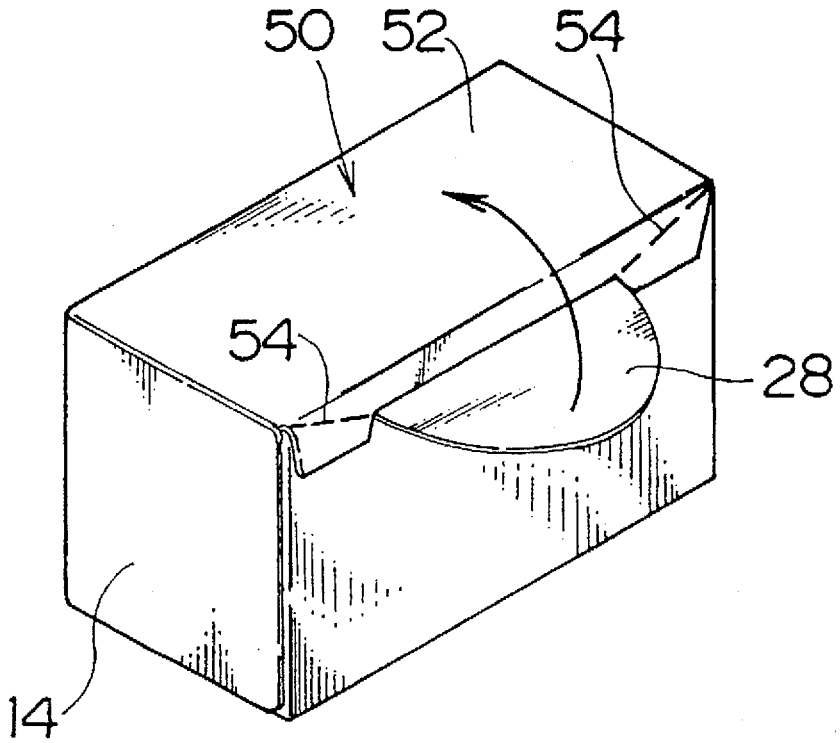
FIG. 8 is an external view illustrating the other embodiment of a package for a film product.

FIG. 8 illustrates a modification of a package for a film product described in the second embodiment.

As shown in FIG. 8, in a carton 50 of a package for a film product, a top wall 52 of the film cartridge part 14 is torn out along tear lines 54 and 54 so that the wrapper can be taken out.

Figure 9:
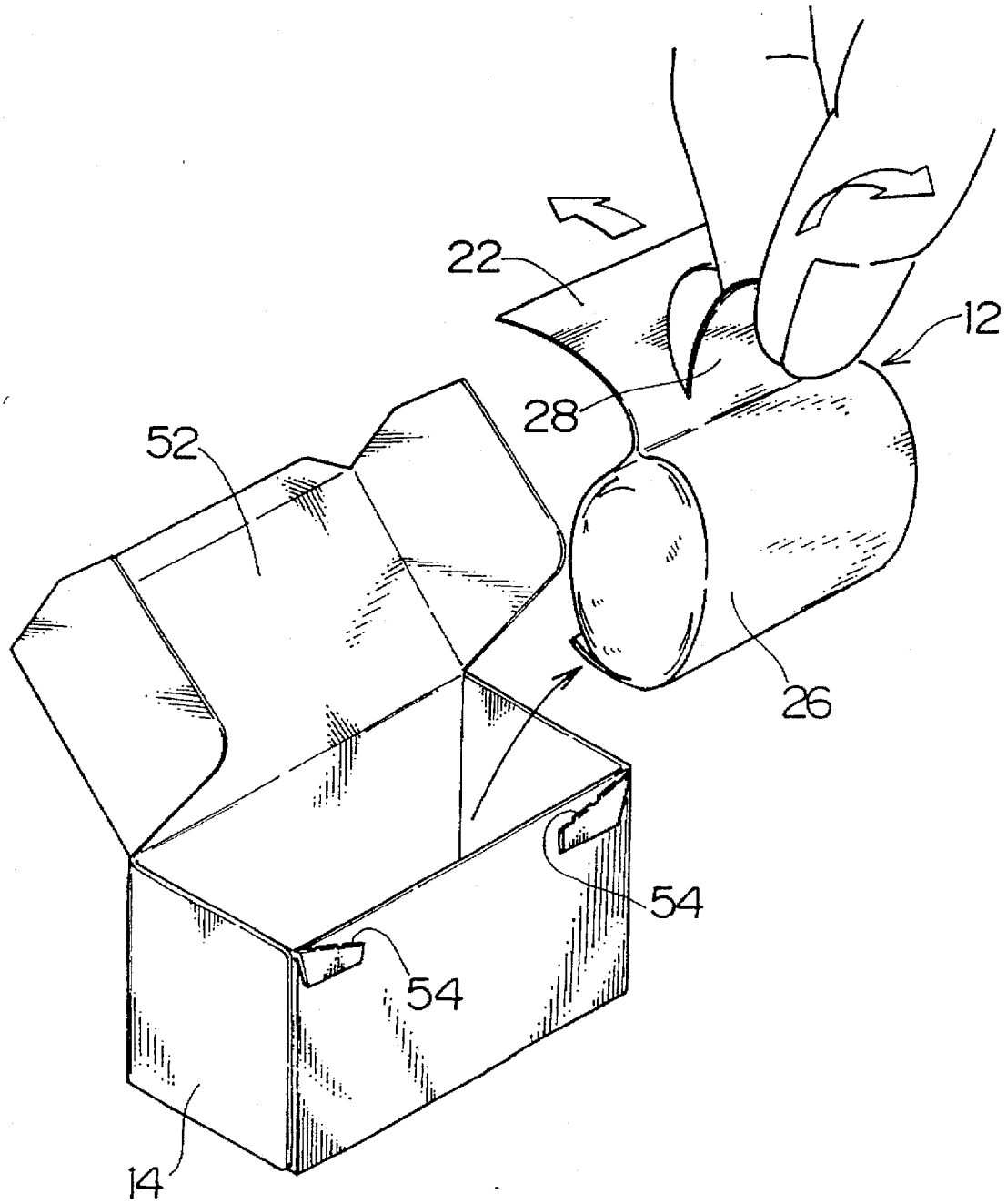
FIG. 9 is an explanatory view illustrating a state that a film cartridge is being taken out from a package for a film product of FIG. 8.

That is, when a tab 28 of the wrapper 12, which projects from the film cartridge housing part 14, is pulled in the direction of an arrow in the drawing, the top wall 52 is torn out along tear lines 54 and 54. Next, the wrapper 12 is taken out from the film cartridge housing part 14 as shown in FIG. 9. Then, the wrapper 12 is torn out by the tab 28, so that the film cartridge can be taken out.

Figure 10:
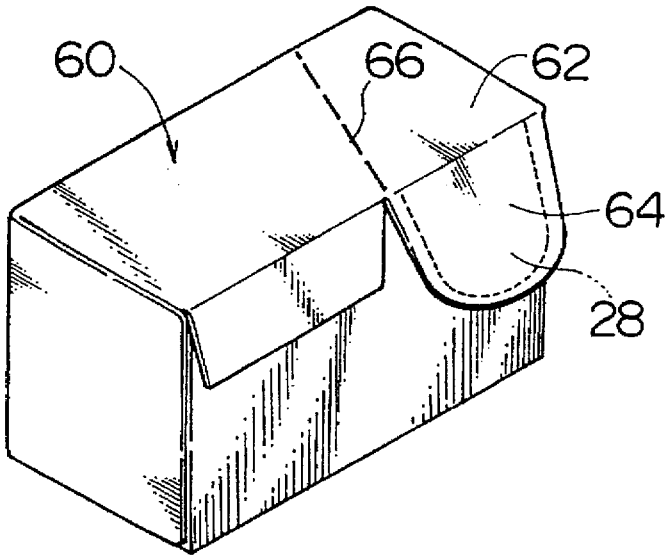
FIG. 10 is a perspective view illustrating an outer appearance of a package for a film product according to the third embodiment of the present invention.

FIG. 10 is a perspective view illustrating the third embodiment of the package for the film product according to the present invention.

A carton 60 has a tab 64 and a tear line 66 on a top wall 62. When the top wall 62 is torn out along the line 66 with the tab 64, a wrapper 12 can also be torn out at the same time.

Figure 11:
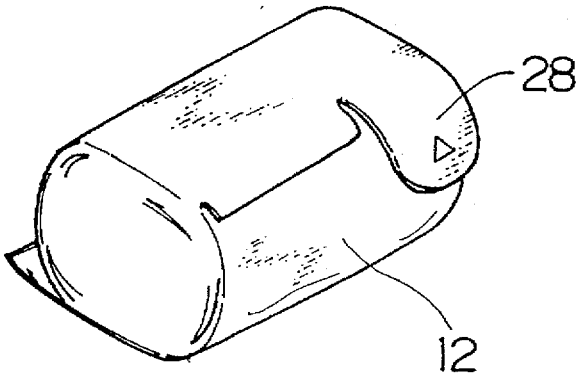
FIG. 11 is a perspective view illustrating an external appearance of a wrapper which seals a film cartridge.
Figure 12:
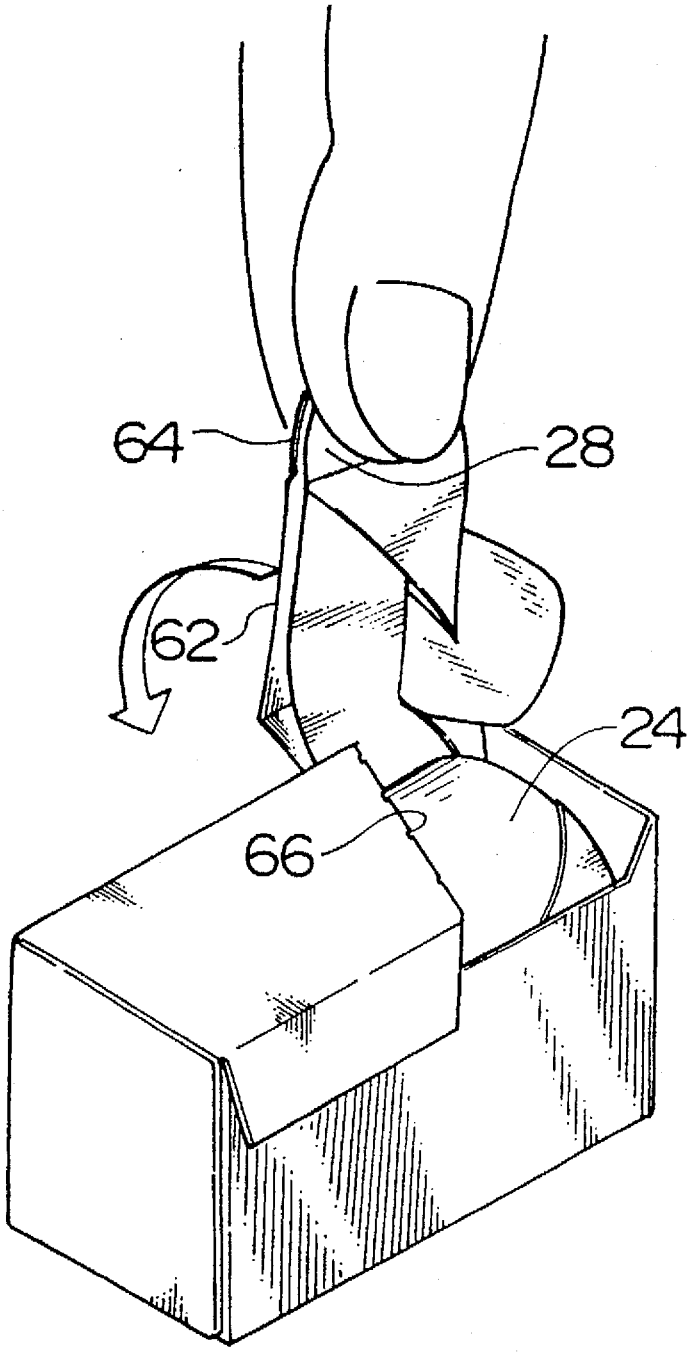
FIG. 12 is an explanatory view illustrating a state that a film cartridge is being taken out from a package for a film product according to the third embodiment of the present invention.

That is, the wrapper 12 is housed in the carton 60 in such a manner that the tab 28 of the wrapper 12 is Glued to the back surface of the tab 64 formed on the top wall 62. As a result, when the tab 64 is pulled as shown in FIG. 12 so that the top panel 62 is torn out along the tear line 66, the wrapper 12 is also torn out at the same time. Accordingly, in the third embodiment, the film cartridge can be taken out by a single tear-out operation just as in the first and second embodiments. The tab 28 of the wrapper 12 is formed as a smaller convex piece than the tab 64 of the top wall 62 as shown in FIGS. 10 and 11. That is, when pinching the tab 64 of the top wall 62, it is possible to tear out the top wall 62 and the wrapper 12 at the same time without pinching the tab 28 of the wrapper 12 directly.

In the third embodiment, the tab 28 of the wrapper 12 and the tab of the top wall 62 are Glued to each other. However, the present invention is not limited to this. It is also possible to tear out the wrapper 12 and the top wall 62 at the same time by pulling the tab 28 which is projected from the top wall 62.

Incidentally, in this embodiment, the package is described as one for a film cartridge, but the present invention is not limited to this. It is also possible to apply it to a film unit with a lens as a simplified camera.

Figure 13:
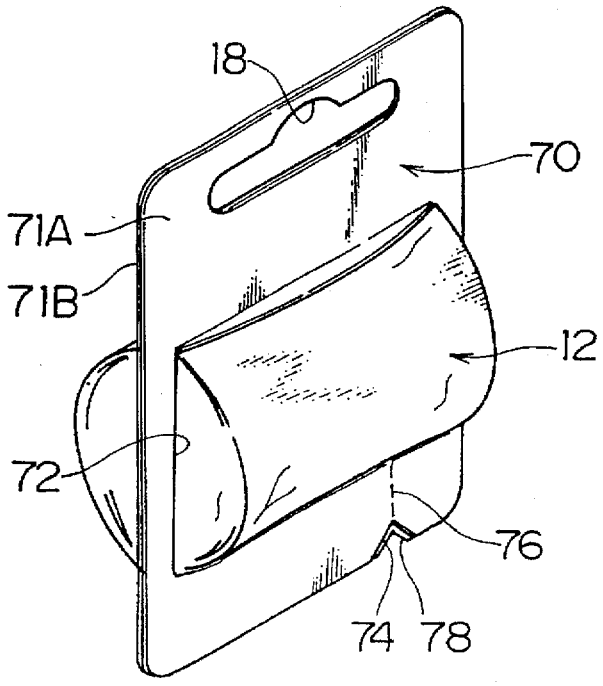
FIG. 13 is a perspective view illustrating an external appearance of a package for a film product according to the fourth embodiment of the present invention.

FIG. 13 is a perspective view illustrating the fourth embodiment of the package for the film product according to the present invention.

The package for the film product in FIG. 13 has such a structure that a wrapper 12 is supported by a mount 70 and is suspended at a store for display and sale.

Figure 14:
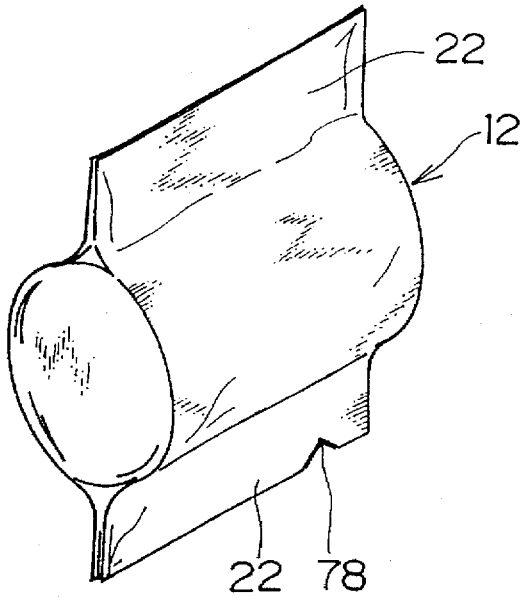
FIG. 14 is a perspective view illustrating an external appearance of a wrapper which seals a film cartridge.

In this case, the wrapper 12 has flatly shaped upper and lower sealed parts 22 and 22 as shown in FIG. 14.

A rectangular opening 72, which exposes the wrapper 12, is formed at a substantially central part on the mount 70, and the wrapper 12 is exposed via the opening 72. A window 18 for suspension is provided above the opening 72. The mount 70 is composed of two pieces of paperboard 71A and 71B. Upper and lower sealed parts 22 and 22 of the wrapper 12 are held between these pieces of cardboard 71A and 71B.

In addition, as shown in FIG. 13, a V-shaped cut is formed at a part where the mount 70 and the lower sealed part 22 overlap each other. A cut 74 is formed on the mount 70, and a cut 78 (refer to FIG. 14) is formed at the lower seal part 22. A tear line 76 is formed in connection with the cut 74 on the mount 70.

Therefore, according to the package for the film product of this embodiment, when the mount 70 is torn out by means of the cut 74 and the tear line 76, the wrapper 12 can be torn out from the cut 78 at the same time. As a result, the film cartridge can be taken out by a single tear-out operation in this embodiment.

Incidentally, in this embodiment, the package is described as one for a film cartridge, but the present invention is not limited to this. It is also possible to apply it to a film unit with a lens as a simplified camera.

Figure 15:
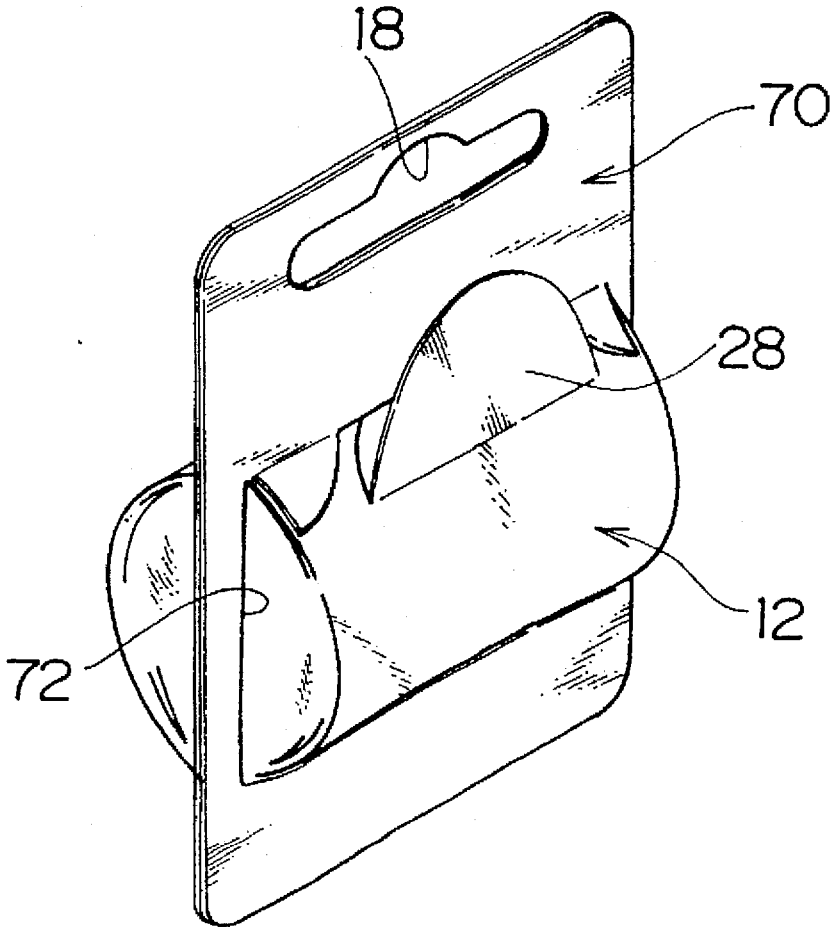
FIG. 15 is an external view illustrating the other embodiment of a package for a film product provided with a mount.

FIG. 15 is a view illustrating a modification of a package for a film product described in the fourth embodiment.

Figure 16:
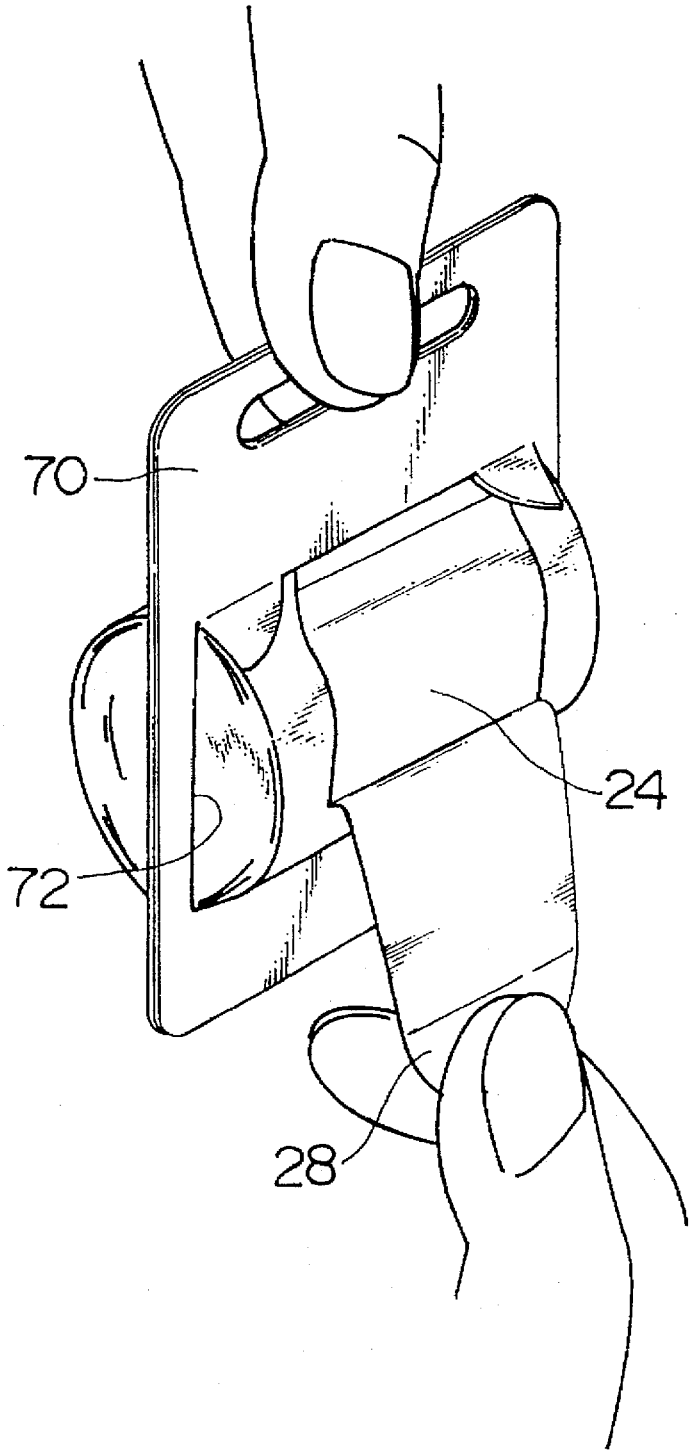
FIG. 16 is an explanatory view illustrating a state that a film cartridge is being taken out from a package for a film product of FIG. 15.

The package for the film product in FIG. 15 has such a structure that a tab 28 is formed on the wrapper 12 which is exposed from the opening 72 in the mount 70. That is, as shown in FIG. 16, when pulling the tab 28, it is possible to tear out the wrapper 12 only, without tearing out the mount 70.

Incidentally, in this embodiment, the package is described as one for a film cartridge, but the present invention is not limited to this. It is also possible to apply it to a film unit with a lens as a simplified camera.

Figure 17:
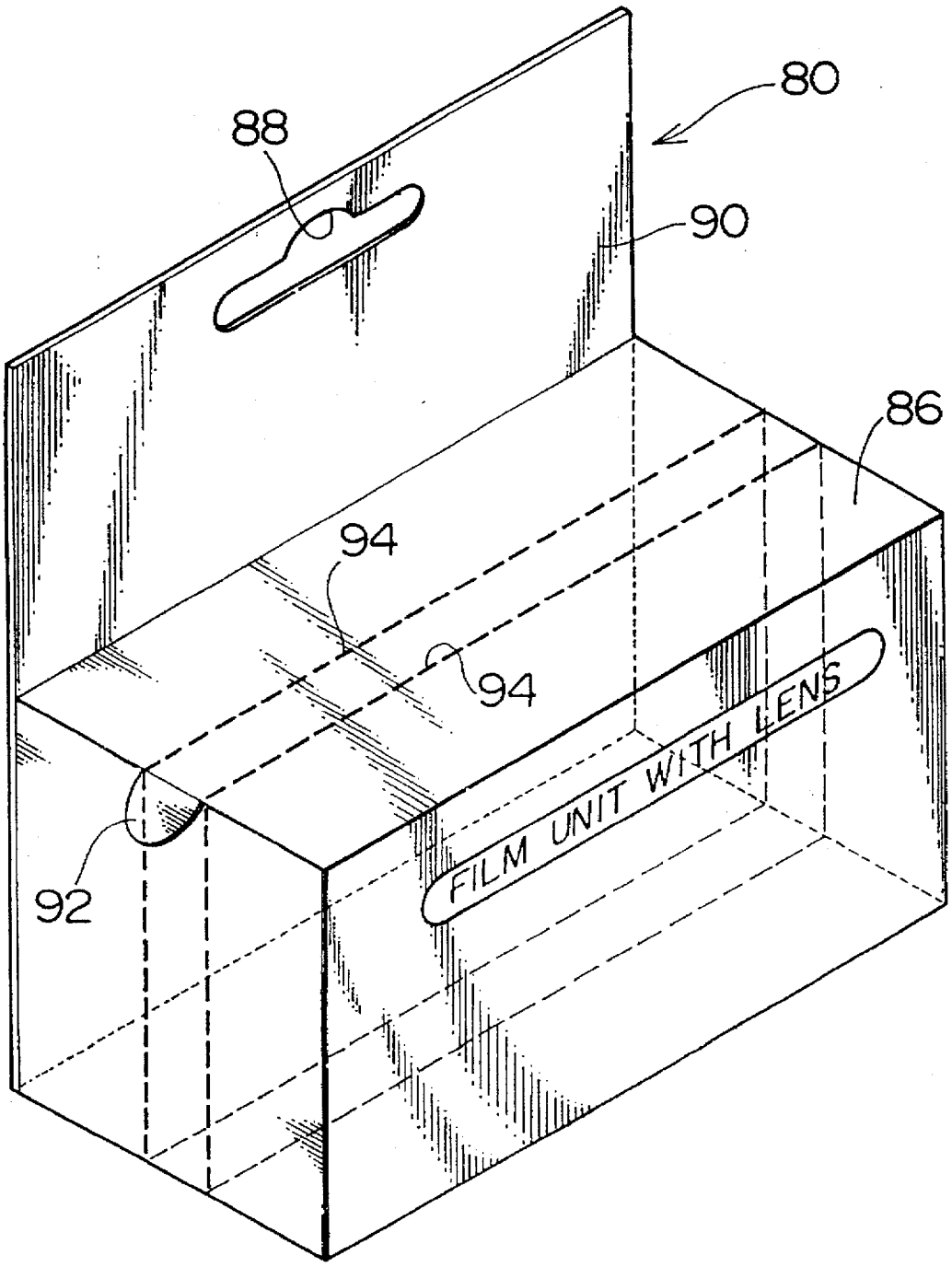
FIG. 17 is an external view illustrating a carton which contains a film unit with a lens; and, FIG. 18 is an explanatory view illustrating a state that a film unit with a lens is sealed in a wrapper.

FIG. 17 is a perspective view illustrating an embodiment of the package for the film product, which packs a film unit with a lens.

Figure 18:
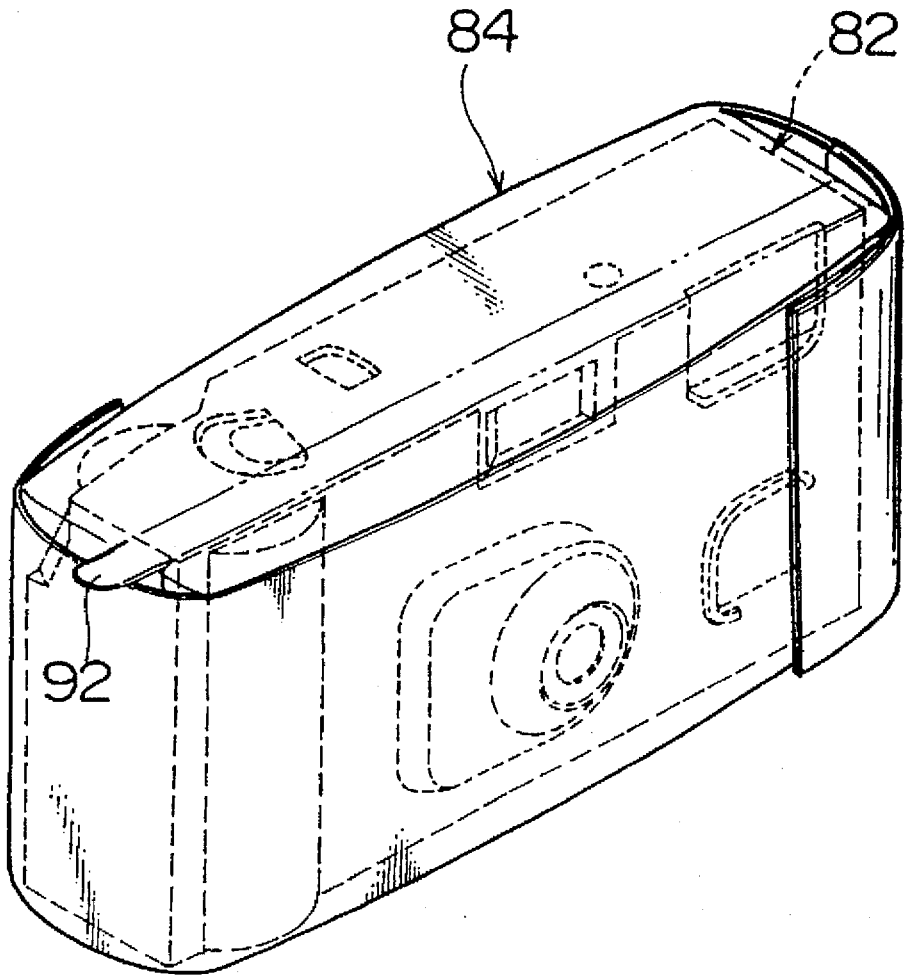

The package for the film product in FIG. 17 comprises a paperboard carton 80 and a wrapper 84 in which a film unit 82 with a lens 82 is sealed as shown in FIG. 18.

As shown in FIG. 17, the carton 80 is composed of a housing part 86 which houses the wrapper 84 and a suspension part 90 in which a suspension window 88 is provided. A tab 92 is formed on the wrapper 84 as shown in FIG. 18. The tab 92 projects toward outside from the upper edge of the carton 80 when the wrapper 84 is housed. Tear lines 94 and 94 are formed around the housing part 86 of the carton 80.

According to the package for the film unit with a lens, which is constructed in the above-mentioned manner, when the tab 92 projecting from the carton 80 is pulled in a tear-out direction, the housing part 86 is also torn out along the tear lines 94 and 94, and the wrapper 84 is torn out at the same time. As a result, the film unit with the lens 82 can be taken out by a simple tear-out operation.

In this embodiment, tear lines are formed on the carton in order to make it easier to tear out the carton. However, there is no need for tear lines if a tension acting on the tab of the wrapper is sufficient to tear out the carton.

The wrapper 12 employed in this embodiment is made of a material which is formed in three layers. An internal layer is a thermoplastic resin sheet such as polyethylene, polypropylene, vinyl chloride, and the like. An external layer is a paper or a sheet made of synthetic resin. Aluminum hoil is applied as a middle layer for a moisture-proofing.

Furthermore, in this embodiment, because the wrapper is separated from the carton and the mount, the carton and the mount are easy to fold. And, the wrapper, the carton and the mount are appropriate for recycling.

As has been described above, according to the package for the film product of the present invention, the wrapper and the carton are torn out by use of the tab of the wrapper, which projects from the carton, at the same time, so that the film product can be easily taken out.

According to the present invention, the tab of the wrapper and the tab of the carton are glued to each other, so that the carton and the wrapper can be torn out at the same time by use of the tab of the carton. As a result, the film product can be easily taken out.

Moreover, according to the present invention, because the carton is formed separately from the wrapper, the carton can be easily folded and the carton and the wrapper are appropriate for recycling.

Furthermore, according to the present invention, a cut is formed in the portion where the wrapper and the carton overlap each other, and the wrapper and the carton are torn out at the same time from the cut. As a result, the film product can be easily taken out.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A package for a film product, comprising:

an inner holder, having an attaching portion in which a film product is contained in a sealed condition; and an outer holder having a securing portion to which said attaching portion of said inner holder is secured, such that said attaching portion and said securing portion are at least partially overlapped so as to define an overlapped portion;

wherein said inner holder and said outer holder are torn away at the same time by manipulating said overlapped portion.

2. A package for a film product according to claim 1, wherein said outer holder comprises at least one of a mount and a carton.

3. A package for a film product according to claim 2, wherein said attaching portion and said securing portion on said carton further comprise a first tab and a second tab, respectively.

4. A package for a film product according to claim 3, wherein said first tab is positioned on a top wall of said carton.

5. A package for a film product according to claim 3, wherein said second tab is secured to a back surface of said first tab.

6. A package for a film product according to claim 5, wherein the second tab is of a convex shape and smaller in size than said first tab.

7. A package for a film product according to claim 4, wherein said second tab projects from said top wall of said carton.

8. A package for a film product according to claim 3, wherein a tear line is formed on said carton along a direction in which said carton is torn away by manipulating said first and second tabs.

9. A package for a film product according to claim 2, further comprising a notch formed on said mount where said mount and said inner holder overlap.

10. A package for a film product according to claim 9, wherein a tear line is formed in connection with said notch on said mount, in a direction in which said mount and said inner holder are torn away.

11. A package for a film product, comprising:

an inner holder containing a film product in a sealed condition, said inner holder including a main body and a flat sealed portion wrapped around a plurality of faces of said main body, said flat sealed portion having a grasping portion formed on one face of said flat sealed portion; and an outer holder having a slit, such that said grasping portion projects from said slit, wherein at least said outer holder is torn away by pulling on said grasping portion.

12. A package for a film product according to claim 11, wherein both said inner holder and said outer holder are torn away by pulling on said grasping portion.

13. A package for a film product according to claim 12, wherein said inner holder further comprises a carton and said grasping portion further comprises a tab.

14. A package for a film product according to claim 13, wherein tear lines are formed on said carton along a direction in which said carton is torn away by pulling on said tab.

15. A package for a film product according to claim 14, wherein said film product is a film cartridge for a roll of photographic film having not been exposed, or a film unit with a lens as a simplified camera, which has not been used.

16. A package for a film product, comprising:

an inner holder containing a film product in a sealed condition, said inner holder including a grasping portion and at least one flatly formed part; and an outer holder comprising flat portions, said flatly formed part of said inner holder being supported between said flat portions, said outer holder having an opening which exposes said grasping portion of said inner holder;

wherein said inner holder is torn away by pulling on said grasping portion.

17. A package for a film product according to claim 16, wherein said outer holder comprises a mount and said grasping portion comprises a tab.

18. A package for a film product according to claim 17, wherein said flat portions of said mount includes two pieces of paperboard adhered to each other.

19. A package for a film product according to claim 18, wherein said opening of said mount is rectangular in shape and formed at a substantially central part of said mount.

20. A package for a film product according to claim 19, wherein an aperture for suspending is formed on said mount above said opening.

21. A package for a film product according to claim 20, wherein said film product is a film cartridge for a roll of photographic film having not been exposed, or a film unit with a lens as a simplified camera, which has not been used.

22. A package for a film product according to claim 16, wherein said outer holder has a frame-like construction defining said opening, and said inner holder is received within said opening.

23. A package for a film product according to claim 2, wherein a tear line is formed on said carton along a direction in which said carton is torn away by manipulating said overlapped portion.

24. A package for a film product according to claim 2, wherein:

said mount includes two pieces of paperboard adhered to each other in which a rectangular opening is formed at a substantially central part; and said inner holder is supported in said opening in such a manner that a flat lower portion of said inner holder is held between said two pieces of paperboard.

25. A package for a film product according to claim 24, wherein said inner holder has an upper flat portion.

26. A package for a film product according to claim 24, wherein an aperture for suspending is formed on said mount above said opening.

27. A package for a film product according to claim 25, wherein a tear line is formed on said mount in a direction in which said mount and said inner holder are torn away.

28. A package for a film product according to claim 3, wherein said film product is a film cartridge for a roll of photographic film having not been exposed, or a film unit with a lens as a simplified camera, which has not been used.

29. A package for a film product according to claim 27, wherein said film product is a film cartridge for a roll of photographic film having not been exposed, or a film unit with a lens as a simplified camera, which has not been used.

* * * * *